US005898265A

United States Patent [19]

Woodward et al.

[11] Patent Number: 5,898,265

[45] **Date of Patent: *Apr. 27, 1999**

[54] TCLP COMPLIANT FLUORESCENT LAMP

[75] Inventors: David R. Woodward; Steven D. McGuire, both of Morgantown, W. Va.; Wim Hellebrekers, Hulst, Netherlands

[73] Assignee: Philips Electronics North America Corporation, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/656,152

[22] Filed: May 31, 1996

[51] Int. Cl.[6] ..... H01J 61/00

[52] U.S. Cl. ..... 313/486; 313/639; 313/565

[58] Field of Search ..... 313/485, 486, 313/487, 489, 546, 550, 565, 639

[56] References Cited

U.S. PATENT DOCUMENTS

| | | | |
|---|---|---|---|
| 3,109,819 | 11/1963 | Gillooly | 252/301.6 |
| 3,255,373 | 6/1966 | Van Broekhoven et al. | 313/109 |
| 3,794,402 | 2/1974 | Ridders et al. | 316/14 |
| 3,967,153 | 6/1976 | Milke et al. | 313/489 |
| 4,289,991 | 9/1981 | Schreurs | 313/489 |
| 4,338,544 | 7/1982 | Komiya et al. | 313/489 |
| 4,907,998 | 3/1990 | Kuijer et al. | 445/9 |
| 5,229,686 | 7/1993 | Fowler et al. | 313/565 |
| 5,229,687 | 7/1993 | Fowler et al. | 313/565 |
| 5,552,665 | 9/1996 | Trushell | 313/489 |

FOREIGN PATENT DOCUMENTS

| | | | |
|---|---|---|---|
| 55-18893 | 2/1980 | Japan | H02K 17/16 |
| 55-146858 | 11/1980 | Japan | H01J 61/48 |
| 57-21065 | 2/1982 | Japan | H01J 61/72 |
| 57-44959 | 3/1982 | Japan | H01J 61/42 |
| 58-218748 | 12/1983 | Japan | H01J 61/54 |
| 60-127652 | 7/1985 | Japan | H01J 61/54 |
| 60-246551 | 12/1985 | Japan | H01J 61/54 |
| 60-249239 | 12/1985 | Japan | H01J 61/54 |
| 1-112651 | 5/1989 | Japan | H01J 61/35 |
| 5-166490 | 7/1993 | Japan | H01J 61/35 |
| 6-76736 | 3/1994 | Japan | H01J 9/14 |

OTHER PUBLICATIONS

SW846, Chapter 9, "Sampling Plan", Revision 0, Sep. 1986.

55 Federal Register 26986, Jun. 29, 1990, Environmental Protection Agency *Identification and Listing of Hazardous Waste*.

Chilcott, "Disposal Dilemma", LD+A, Oct. 1995, pp. 29–31.

"Measurement of Mercury Bound in the Glass Envelope During Operation of Fluorescent Lamps", by E.G. Thaler et al, J. Electrochem. Soc., vol. 142, No. 6, Jun. 1995, pp. 1968–1970.

SW846, Method 1311, Revision 0, Jul. 1992, "Toxicity Characteristic Leaching Procedure".

SW846, Method 7470A, Revision 1, Sep. 1994, "Mercury in Liquid Waste (Manual Cold–Vapor Technique)".

"A Study of Mercury Consumption In Fluorescent Lamps", 7th International Symposium on the Science and Technology of Light sources, by Tomioka, Higashi and Iwami (Jun. 1993), pp. 323–324.

*Primary Examiner*—Sandra O'Shea
*Assistant Examiner*—Michael Day
*Attorney, Agent, or Firm*—Brian J. Wieghaus

[57] ABSTRACT

A low pressure mercury vapor fluorescent lamp includes a lamp vessel having a mercury protective coating on the inner surface of the lamp envelope and a halophosphate phosphor layer. The lamp has a discharge sustaining filling including mercury and a rare gas. The level of mercury is selected such that the lamp has a standard average lamp life of about 20,000 hours while passing the Environmental Protection Agency's Toxicity Characteristic Leachate Procedure (TCLP) test and the State of California's Waste Extraction Test (WET).

21 Claims, 5 Drawing Sheets

TCLP COMPLIANT FLUORESCENT LAMP

BACKGROUND OF THE INVENTION

1) Field of the Invention

The invention relates to low pressure mercury vapor fluorescent lamps.

2) Description of the Prior Art

Lighting accounts for approximately 20–25% of the electricity used annually in the United States. For stores, offices and warehouses, lighting may account for up to 50% of their electrical consumption. The Environmental Protection Agency (EPA), through its Green Lights program, encourages commercial, industrial and public facilities to switch to energy efficient lighting. Efficient lighting reduces the need for electric power generated through the burning of fossil fuels and the harmful air pollutants generated thereby.

Low pressure mercury vapor lamps, more commonly known as fluorescent lamps, are a key element in the Green Lights Program. These lamps have a lamp envelope with a filling of mercury and a rare gas and in which a gas discharge is maintained during lamp operation. The radiation emitted by the gas discharge is mostly in the ultraviolet region of the spectrum, with only a small portion in the visible spectrum. The inner surface of the lamp envelope has a luminescent coating, often of a blend of phosphors, which emits visible light when impinged by the ultraviolet radiation.

While the use of fluorescent lamps was being promoted during the late 1980's and early 1990's, there was also growing concern about the disposal of an ever-increasing number of these lamps, due to their mercury content. In 1990 the Environmental Protection Agency (EPA) established the Toxicity Characteristic Leaching Procedure (TCLP) test, which created additional challenges for manufacturers and users of fluorescent lamps. The TCLP test simulates the leaching effects of mildly acidic rainwater in landfills on solid waste. The test procedure is set forth at pages 26,987–26,998 of volume 55, number 126 of the Jun. 29, 1990 issue of the Federal Register (herein incorporated by reference). The lamp being tested is pulverized into granules having a surface area per gram of materials equal to or greater than 3.1 $cm^2$ or having a particle size smaller than 1 cm in its narrowest dimension. The granules are then subject to a sodium acetate buffer solution having a PH of approximately 4.9 and a weight twenty times that of the granules. The buffer solution is then extracted and the concentration of mercury is measured. In order for fluorescent lamps to be considered non-hazardous and lawfully disposable in landfills (the cheapest option), the lamps must pass the TCLP test for mercury by meeting a regulatory threshold of 0.2 mg per liter (0.2 ppm) in the leachate.

Disposal of fluorescent lamps is therefore a serious issue for most industrial/commercial facilities. Hazardous waste regulation means that large office buildings and other typically non-hazardous manufacturing facilities are now subject to all of the requirements of a hazardous waste generator. In response to these concerns, a recycling/reclamation industry has established itself in the United States for fluorescent lamps, but at a substantial cost to end users. Recycling facilities gather the mercury from fluorescent lamps by retorting, selling the aluminum bases, and finding various uses for the glass. Some facilities are run as Subtitle C (hazardous waste) facilities. Disposal at non-Subtitle C facilities is approximately seven to twelve cents per foot ($0.28 to $0.50 for a 4 ft. lamp) and at a Subtitle C facility is $1.00 to $1.50 for each 4 ft. lamp.

U.S. Pat. Nos. 5,229,686 and 5,229,687 (both to Fowler et al) disclose two techniques for reducing the soluble mercury extracted in the TCLP test. The lamp is provided with an agent for chemically removing a substantial quantity of the soluble mercury when the lamp is pulverized to granules and subjected to the TCLP buffer solution. The '686 patent discloses the use of various salts, such as potassium periodate, which tie up the mercury ions as an insoluble mercury compound. The '687 patent discloses the use of metals having an oxidation potential higher than mercury, such as iron, tin and copper, which reduce the mercury ions to elemental Hg, which is only sparingly soluble and is detected at only a very low level by the test. These agents are provided in a container in the lamp or lamp cap to be pulverized along with the lamp.

SUMMARY OF THE INVENTION

Generally speaking, according to the invention, a low pressure mercury vapor fluorescent lamp includes a light transmissive lamp envelope sealed in a gas-tight manner and having an inner surface. A discharge sustaining filling within the lamp envelope includes elemental mercury and rare gas. A luminescent layer comprising a halophosphate phosphor and adjacent the inner surface of the lamp envelope converts ultraviolet radiation emitted by the mercury discharge into visible light. The lamp further includes a mercury-protective layer comprising an oxide formed from the group consisting of magnesium, aluminum, titanium, zirconium, and the rare earths on the inner surface of the lamp envelope. The initial dose of elemental mercury is provided in such a quantity that:

(A) after about 20,000 hours of lamp operation a sufficient quantity of elemental mercury is available to support a column discharge, and (B) after said lamp is (1) pulverized into granules having a surface area per gram of pulverized material equal to or greater than 3.1 $cm^2$ or having a particle size smaller than 1 cm for the narrowest dimension of said particle and (2) the pulverized material is subjected to a sodium acetate buffer solution having a PH of approximately 4.9 and a weight 20 times that of the pulverized granules, the maximum concentration of mercury in said leachate is less than 0.2 ppm. The lamp is free of additional chemicals provided only for converting soluble mercury into insoluble mercury upon crushing of the lamp.

The invention is based on the discovery that it is possible to manufacture a lamp that has a standard life (without reduced photometric performance) and which qualifies to be disposed of as non-hazardous waste without providing additional agents that act upon crushing of the lamp to convert mercury from one form to another. As used herein, the term "standard life" means an average lamp life of 20,000 hours. Applicants discovered that in a lamp having a mercury-protective layer, a TCLP-qualifying standard life lamp could be achieved by selecting the initial dose at a level which is significantly lower than lamps currently available in the market. This is a real advantage, since the lamps pass the TCLP test through actual reduction in the amount of mercury in the lamp. Thus, the lamps according to the invention embody the spirit of the TCLP test of reducing the mercury in the environment through significant reductions at its source, rather than by altering or masking conventional levels of mercury in the lamp by providing additional reactive agents to pass the TCLP test. Furthermore, with the additives provided in the manner known from the '686 and '687 patents, it is unlikely that such lamps when disposed of in a landfill would be crushed in the same controlled manner as prescribed by the TCLP test, thereby releasing more mercury into the environment than would otherwise be indicated by a controlled TCLP test.

In one embodiment, the initial mercury dose selected was between an upper limit of about $4.4\times10^{-3}$ mg/cm$^3$of the volume enclosed by the lamp envelope and a lower limit of about $2.9\times10^{-3}$ mg/cm$^3$. This corresponds to an upper limit of about 6 mg and a lower limit of about 4 mg for an F40T12 lamp. By comparison, the average industry dose for this type of lamp is $16.2\times10^{-3}$ mg/cm$^3$ as reported by the National Electrical Manufacturers Association (NEMA).

It was a surprise to find that a lamp with a halophosphate phosphor layer at the above mercury doses could have a standards life of at least 20,000 hours while still passing the TCLP test. Lamps having a tri-component narrow band phosphor and a mercury protective coating of aluminum oxide are known in the art. Previous studies have shown that lamps having a halophosphate phosphor with the same mercury protective coating have a significantly higher mercury consumption than lamps with a tri-component phosphor. The article "A Study of Mercury Consumption In Fluorescent Lamps", 7th International Symposium on the Science and Technology of Light Sources, by Tomioka, Higashi and Iwami (June 1993) discusses that the effect of an aluminum oxide coating on mercury consumption for a lamp in which the phosphor is a halophosphate is insignificant. The article shows that even with an aluminum oxide layer, the halophosphate lamp has a mercury consumption of approximately 2.5 mg mercury at only 4000 hours. With this published mercury consumption for a halophosphate/aluminum oxide lamp, it would not be expected that a lamp of this type would have an average lamp life of 20,000 hours with the low mercury doses according to the invention.

In an embodiment of the invention, the lamp envelope is tubular and includes a conventional electrode mount construction. The mount construction includes lamp stems sealing opposing ends of the lamp envelope in a gas-tight manner and carrying a respective tungsten filament electrode supported by conductive feed-throughs extending through the stems. The stems are free of the mercury protective coating. This has the advantage that the protective coating can be applied in a conventional fashion, such as by flushing a solution over the inner surface of the tube followed by lehring, without taking special measures to coat the stems which could be problematic for sealing the glass stems to the glass envelope.

In another embodiment of the invention, the lamp includes an additional phosphor layer of a tri-component narrow-band phosphor up to about 40% of the total weight of the phosphor. It has been found that in a lamp with a mercury protective layer such additional tri-component phosphor provides a TCLP response which does not statistically differ from such a lamp with only a halophosphate layer.

In yet another embodiment of the invention, the mount construction includes a metallic cathode guard surrounding the filament. Such a cathode guard is normally present to reduce cathode fall and also prevents blackening of the lamp envelope caused by sputtering of the electrode. It has been found that the presence of the metallic cathode guard has a small, but measurably beneficial influence in meeting the TCLP requirements.

In still another embodiment of the invention, the lamp includes a capsule within the lamp envelope. The capsule is initially sealed and is a carrier for the mercury dose. After the lamp envelope is sealed in a gas-tight manner, the capsule is opened to allow the mercury dose to enter the discharge space enclosed by the lamp envelope. This technique has been found to be very favorable for dosing the relatively low mercury levels according to the invention, with sufficiently tight tolerances to allow production lamps to pass the statistical requirements of the TCLP test.

Accordingly, it is an object of the invention to provide a fluorescent lamp which passes the TCLP test.

It is another object of the invention to provide such a lamp without reducing lamp life or photometric performance below that of otherwise comparable commercially available lamps.

These and other features and advantages of the invention will be further described with reference to the following drawings, detailed description and claims.

DESCRIPTION OF THE PREFERRED EMBODIMENTS

Figure 1:
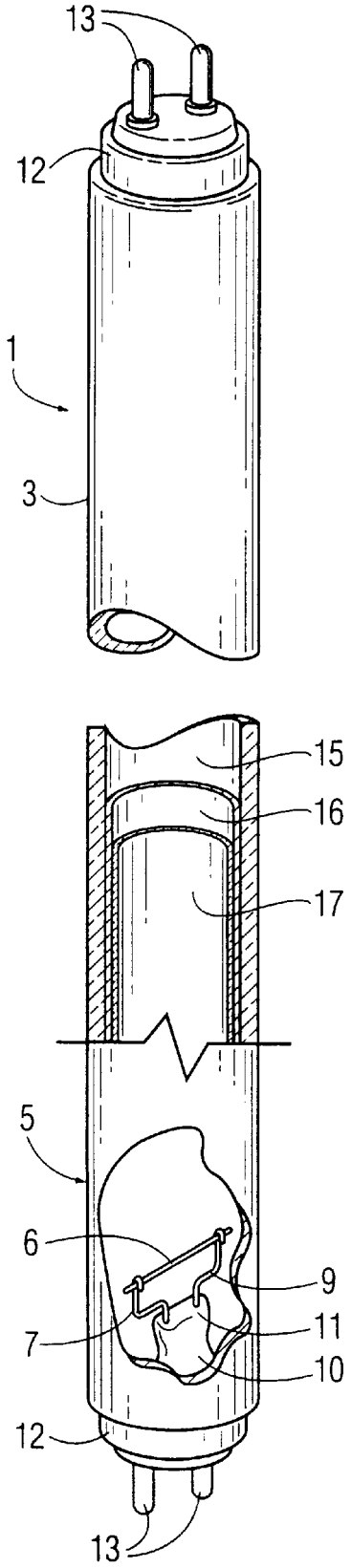
FIG. 1 is a perspective view of a fluorescent lamp according to the invention, partly in cross-section, partly broken away.

FIG. 1 shows a low pressure mercury vapor fluorescent lamp 1 with an elongated lamp vessel, or bulb, 3. The bulb is of a conventional soda-lime glass. The lamp includes an electrode mount structure 5 at each end which includes a coiled tungsten filament 6 supported on conductive feed-throughs 7 and 9 which extend through a glass press seal 11 in a mount stem 10. The mount stem is of a conventional lead-containing glass. The mount structure further includes a cathode guard assembly, which will be shown and discussed with respect to FIG. 2. The stem 10 seals the envelope in a gas tight manner. The leads 7, 9 are connected to the pin-shaped contacts 13 of their respective bases 12 fixed at opposite ends of the lamp.

The inner surface 15 of the outer envelope 3 is provided with a mercury-protective layer 16 and a phosphor coating 17 disposed over the layer 16. The layer 16 is provided to reduce the rate of mercury depletion caused by reactions with the glass of the envelope. The layer 16 may be an oxide formed from the group consisting of magnesium, aluminum, titanium, zirconium and the rare earths. As used herein, the term "rare earths" means the elements scandium, yttrium, lanthanum and the lanthanides. Both coatings extend the full length of the bulb, completely circumferentially around the bulb inner wall. The stems 10 are free of any of the above coatings.

Figure 2:
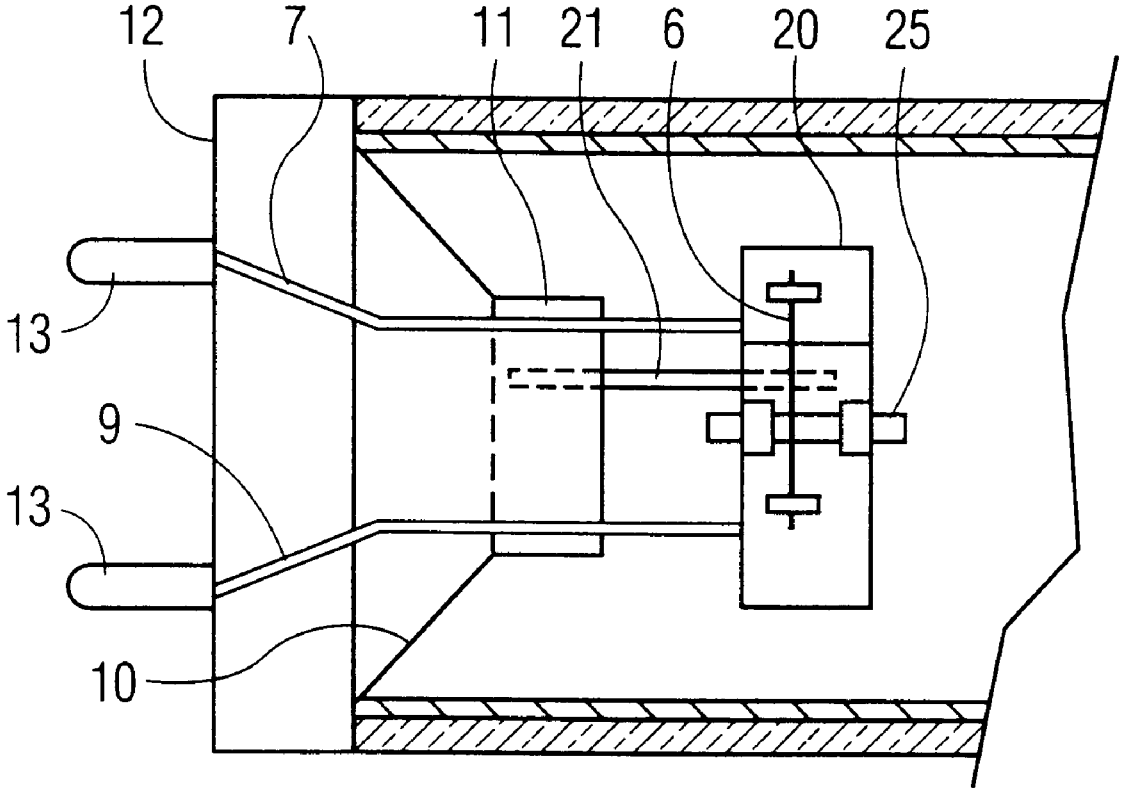
FIG. 2 is a side view showing a cathode guard/mercury capsule construction employed in the lamp of FIG. 1.

The discharge-sustaining filling includes an inert gas such as argon, or a mixture of argon and other gases, at a low pressure in combination with a quantity of mercury to sustain a column discharge during lamp operation. As shown in FIG. 2, the lamp of FIG. 1 further includes a metallic cathode guard 20, in the form of a strap of nickel coated iron encircling each filament electrode and supported by a metallic guard support 21 having an end embedded in the seal 11. A glass capsule 25 is clamped to one of the guards as shown in FIG. 2 and includes a metal wire (not shown) encircling the capsule. The glass capsule is provided with a dose of mercury. After the lamp is sealed, the mercury is released from the capsule into the discharge space enclosed by the envelope by inductively heating the glass capsule in a high frequency electromagnetic field, which causes the wire to cut the capsule. Such a capsule and technique are known from U.S. Pat. No. 3,794,402 (herein incorporated by reference).

According to a particular embodiment, the lamp shown in FIGS. 1 and 2 is an F40T12 ECONOWATT™ ("EW")lamp. Such a lamp has a rated power consumption of 34 W. The lamp envelope has a length of about 4 ft. (120 cm), an internal diameter of about 3.8 cm, an internal surface area of the wall of the discharge space of about 1436 $cm^2$ and an internal volume of the discharge space of about 1360 $cm^3$. The gas fill includes a krypton/argon mixture (85%/15%). Krypton is known to increase lamp efficacy as compared to a 100% argon fill. Krypton, however, increases ignition voltage. To enable the lamps to start on a ballast designed for a 100% argon mixture, the lamp is provided with an electrically conductive coating (not shown) directly on the inner surface of the envelope, under the layer 16. The electrically conductive layer is tin oxide ($SnO_2$) having a coating weight of about 70 $mg/cm^2$ of the inner surface of the lamp envelope. A suitable range is 50 to 100 $mg/cm^2$. Other coatings suitable for this purpose include indium tin oxide $In_2O_3$-$SnO_2$. The mercury-protective coating is aluminum oxide of predominantly gamma alumina having a primary crystallite size of about 0.01 $\mu$m with a weight per surface area of about 0.08 $mg/cm^2$. A suitable range is 0.075 to 0.3 $mg/cm^2$. The phosphor layer 17 is a halophosphate phosphor having a coating weight of about 4–5 $mg/cm^2$. Halophosphates are relatively inexpensive phosphors widely used in the lamp industry. As discussed, for example, in U.S. Pat. No. 3,255,373, halophosphate materials are analogous to the natural mineral apetite and are represented by the matrix $3M_3(PO_4)_3 1M'L_2$, where L represents a halogen or mixture of halogens and M and M' represent bivalent metals or mixtures of such metals. The particular halophosphate phosphor in the disclosed implementation is a cool white phosphor—$Ca_5$ (F, Cl) $(PO_4)_3$:Sb:Mn. The tungsten electrodes carried a conventional emitter material of barium, calcium and strontium oxides.

It is generally known that over lamp life the amount of mercury available to support the discharge is gradually reduced, due for example, to absorption and/or reaction with the phosphors in the luminescent layer and the glass of the envelope itself. (See, for example, Thaler, E. G., "Measurement of Mercury Bound in the Glass Envelope during Operation of Fluorescent Lamps", J. Electrochem. Soc., Vol. 142, No. 6, pp. 1968–1970, June 1995) Due to this mercury reduction, lamps have traditionally been dosed to insure that lamp life is determined primarily by (i) electrode failure and (ii) degradation of the photometric parameters to a prescribed level, and not by failure of the lamp to ignite and support a discharge because of mercury starvation. Because of environmental concerns, the long term industry trend has been to lower the amount of mercury in fluorescent lamps. According to a publication by the National Electrical Manufacturers Association ("NEMA") entitled "The Management of Spent Electric Lamps Containing Mercury" (July 1995), the average amount of mercury contained in a 4-foot T12 lamp ten years ago was 48.2 mg. That Figure was reduced to 41.6 mg in 1990 and lowered to 22.8 mg in December 1994. The lighting industry has established a goal of bringing the average mercury content for an F40T12 to below 15 mg by the year 2000.

In view of the latter industry goal, it was surprising to find that the F40T12 lamps having an initial mercury dose of less than about $4.4\times10^{-3}$ $mg/cm^3$ (6 mg) could operate out to an average lifetime of 20,000 hours and without a degradation in photometric performance as compared to known lamps having a much higher filling of 22.8 mg mercury. It was also surprising that these lamps passed the TCLP mercury leachate test, without the addition of agents to reduce the level of soluble mercury upon crushing of the lamp.

It should be noted that four (4) foot T8 fluorescent lamps are commercially available in Europe which have a tri-component narrow band phosphor and an aluminum oxide coating. These lamps have an initial mercury dose of about 3 mg mercury, which corresponds to $4.9\times10^{-3}$ $mg/cm^3$. Such lamps have a standard life, but as known from the above-cited Tomioka article, also would be expected to have significantly lower mercury consumption. Furthermore, such T8 lamps are operated in a pre heat mode whereas T12 lamps in the U.S. are predominantly operated in a rapid-start mode. The different operating modes effect mercury consumption. Accordingly, such lamps do not provide an insight as to the mercury dose for a halophosphate lamp to achieve standard life or to pass the TCLP test.

LIFE TESTS

Initial tests were conducted to study mercury depletion in F40T12 lamps. A method based on cataphoresis was used, in which the lamp is operated on DC. The transport time of mercury from one end of the lamp to the other using artificial cold spots provides a measure for the quantity of mercury available for supporting the discharge which remains in the lamp. The results showed that much less than 6 mg of elemental mercury were consumed after 15,000 hours of lamp operation, indicating that lamps provided with an initial does of only 6 mg could have a life on the order of the standard life of about 20,000 hours. A first group of lamps were of the above-described EW type with an 85%/15% krypton argon fill and an electrically conductive coating of tin oxide. A second group had a 100% argon fill, without the tin oxide coating but with the same phosphor. The initial tests also revealed that lamps with 2 mg dose failed due to mercury starvation as early as 2800 hours.

Figure 3:
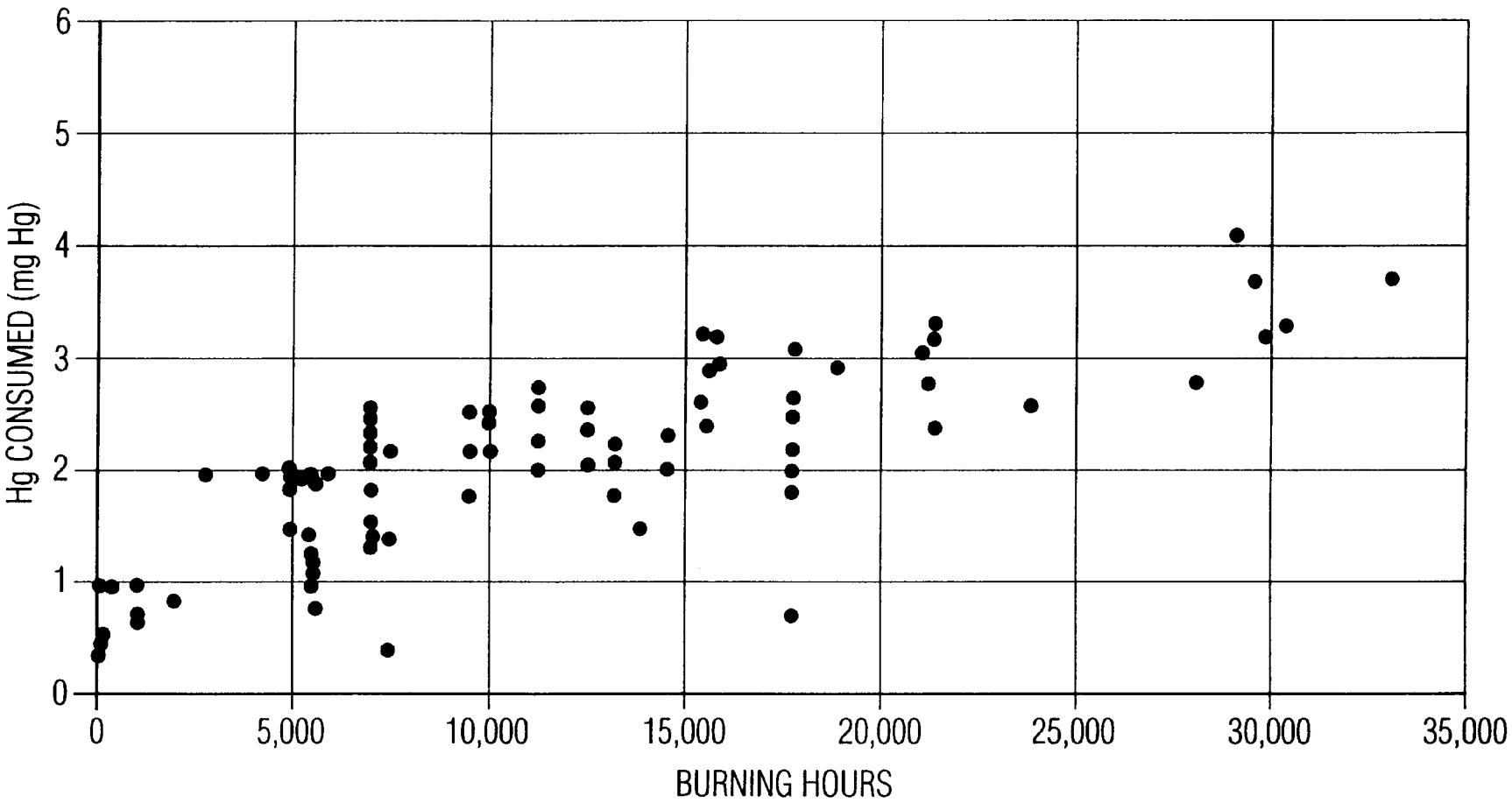
FIG. 3 is a graph of mercury consumption verses lamp burning time for F40T12 lamps according to a life test.

An extensive life test was then conducted using three thousand (3000) F40T12 ECONOWATT lamps having an initial dose of 6±0.5 mg of mercury. Lamps were operated on a variety of ballasts and operating cycles. A first group of lamps was operated on a regular burning test cycle (i.e. 3 hours on/20 minutes off). The mercury consumption for a sub-group of these lamps was determined and is shown in FIG. 3. The results are consistent with a standard lamp life of 20,000 hours. At 20,000 hours, these lamps had a mercury consumption of less than 3.5 mg. In FIG. 3, the lamps grouped around the 30,000 hour mark were operated in a different manner, with a constant burn cycle, i.e. always on.

TCLP COMPLIANCE

During the life test, a number of lamps were selected and subjected to the TCLP test. The tests were performed on 0-hour lamps which were never burned, lamps which had operating times of 5000–30,000 hours, and lamps which had failed due to the normal failure mode of coil breakage. The lamps were analyzed according to the TCLP procedures for mercury described in SW-846, Method 1311, Revision 0, July 1992, and Method 7470A, Revision 1, September 1994, of the EPA's manual on solid waste testing, herein incorporated by reference. The TCLP tests were conducted by independent laboratories using the test protocol developed by Science Applications International Corporation of Falls Church, Va. (the "SAIC Protocol"), herein incorporated by reference, which deals with the particulars of lamp preparation for the TCLP test. The data was analyzed using the statistical approach given in Chapter 9 of SW-846, Revision 0, September 1986.

The TCLP test is widely believed to preferentially detect soluble mercury compounds as opposed to metallic, elemental mercury. Soluble mercury compounds are believed to be formed in fluorescent lamps as they are operated. Consequently, lamps with longer burning times are expected to have higher TCLP responses than lamps which have not been burned or lamps with only short burning times. Data on 70 lamps with 6 mg doses were evaluated which failed due to mercury depletion (the worst case scenario). The average TCLP response for these 70 lamps was 0.097 ppm with a standard deviation of 0.028 ppm compared to the regulatory threshold of 0.2 ppm. The 80% confidence interval for this end-of-life data, as calculated by the EPA's SW 846 methodology, is 0.0918–0.101 ppm. Since the upper limit is well below the regulatory threshold of 0.2 ppm, the lamps pass the TCLP test and are considered non-hazardous and may be disposed in landfills.

Figure 4:
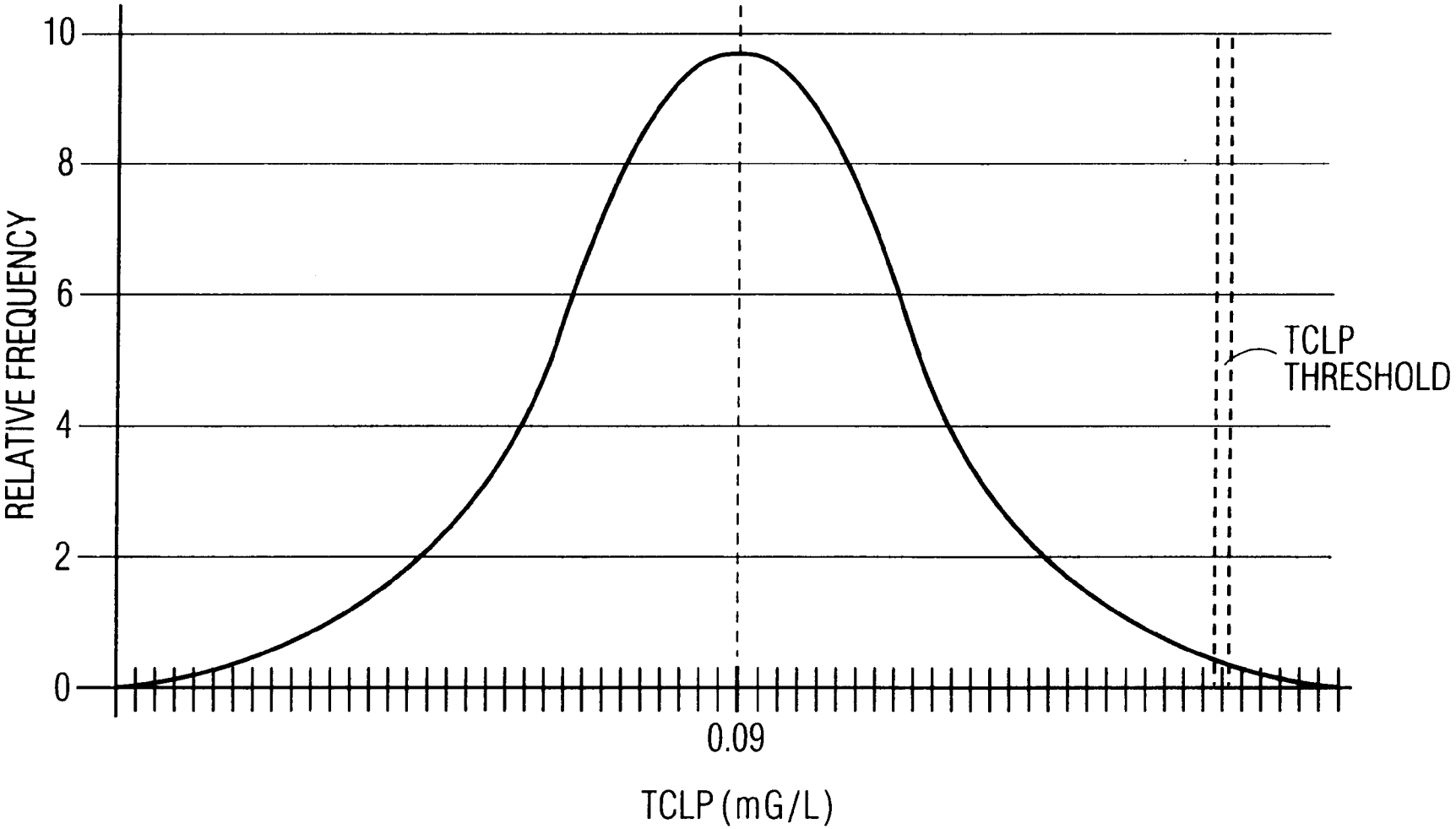
FIG. 4 is a graph illustrating the TCLP results for an F40T12 lamp according to the invention.
Figure 5:
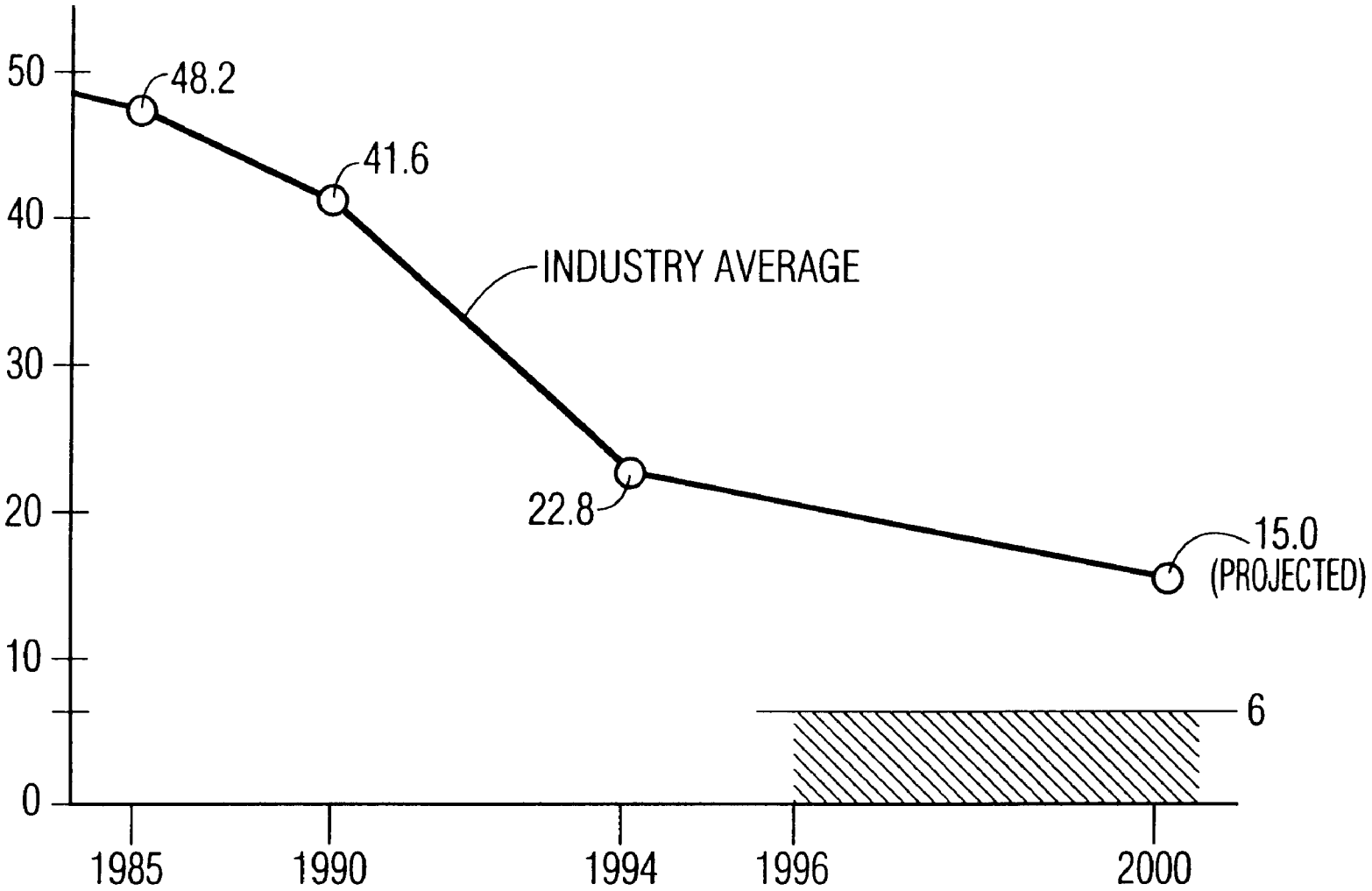
FIG. 5 is a graph of mercury content for an F40T12 lamp projected for the industry verses that according to the invention.

FIG. 4 shows the TCLP response curve for the above described EW lamp having a mercury dose of 6 mg±0.5 mg. FIG. 5 shows the much lower initial mercury dose for an F40T12 halophophate phosphor lamp according to the invention as compared to the 1994 industry projection for these lamps.

The metallic cathode guard was found to have only a small beneficial effect on the TCLP response. In tests of identical lamps with and without the cathode guard, the lamps with the cathode guard were found to have a lower TCLP response by only a few percent. This is believed to be due to the ability of the nickel iron metal to bind soluble mercury, thereby minimally reducing the amount of soluble mercury detectable by the TCLP test. Otherwise identical lamps without the cathode guard also passed the TCLP test.

Additionally, the use of a capsule-type dosing system has been found to be beneficial because the accurately measured dose is retained in the sealed capsule during lamp manufacture. The dose can be provided in the capsule in a relatively clean environment away from the main production line. After the lamp is sealed in a gas-tight manner with the sealed capsule inside the lamp envelope, the capsule is opened in a non-obtrusive fashion with a high frequency magnetic field. With this system, it has been found that the tolerances can be kept to within about 0.5 mg, which is sufficient at the low end to meet standard life while at the upper end to meet the TCLP requirements. If other dosing systems are used, the mercury dose should be selected to account for the particular tolerances, so that the lamps maintain an average lamp life of 20,000 hours with the lowest expected mercury dose while passing the TCLP test at the high end of the mercury dose range expected with the particular dose tolerances.

EPACT COMPLIANCE

The National Energy Policy Act of 1992 mandates energy efficiency standards for various lamp types in terms of lamp efficacy and color rendering. Four (4) foot fluorescent lamps must meet the following requirements:

FLUORESCENT LAMP STANDARDS

| LAMP | NOMINAL LAMP WATTAGE | MINIMUM CRI | MINIMUM AVERAGE LAMP EFFICACY (LPW) |
|---|---|---|---|
| 4-FOOT | >35 W | 69 | 75.0 |
| MEDIUM BI-PIN | ≦35 W | 45 | 75.0 |

Standard F40T12 cool white lamps, with a 100% argon fill and without the tin oxide coating, do not meet this standard and can no longer be sold. However, the EW lamp described above with the krypton in the fill gas and the tin oxide coating has a nominal wattage of 34 W, with a lamp efficacy of 76 LPW and color rendering of 62 CRI, and passes the EPACT standard.

When aluminum oxide is used for the mercury-protective coating, it has been found to substantially improve the lumen output of the lamp when applied in a coating weight of between about 0.15 mg/cm$^2$ and about 0.3 mg/cm$^2$. With a primary crystallite size of less than about 0.05 $\mu$m, the aluminum oxide is transmissive to visible light and reflective of ultraviolet radiation. However, adequate mercury protection for TCLP purposes is provided down to a coating weight of 0.08 mg/cm$^2$. The aluminum oxide is applied in the manner described in U.S. Ser. No. 08/366,134 filed Dec. 29, 1994 U.S. Pat. No. 5,552,665 of Charles Trushell entitled "Electric Lamp Having An Undercoat For Increasing The Light Output of a Luminescent Layer" (herein incorporated by reference). Thus, the lamp according to the above-described embodiment passes the EPACT standards, while also having a standard life and passing the TCLP test.

It has also been found that lamps with an addition of a narrow band tri-component phosphor of up to 40% by weight of the total weight of the halophosphate and tri-component phosphor, in the presence of the mercury protective layer, had TCLP responses which did not differ in a statistically significant manner from the above described ECONOWATT lamps. The tri-component phosphor layer consisted of the known phosphors BAM (blue), YOF (red) and CAT (green) in a layer over the halophosphate layer, i.e., closer to the discharge. The narrow band phosphors improve the lamp colorimetrics over that obtained with a halophosphate phosphor alone.

OTHER EMBODIMENTS

The TCLP compliance for the above-mentioned F40T12 EW lamp was initially measured in accordance with SW-846 and the SAIC Protocol. The results reported above were obtained with a two vessel extraction technique in which the lamp is divided in two, each half being placed in a respective vessel with the required weight of extract solution. The TCLP compliance was also measured in accordance with other protocols proposed for fluorescent lamps by the lamp industry, which protocols differ slightly therefrom, for example, in the manner the lamp is crushed, separated and filtered, or in the length of time between filtering the leachate and measuring the quantity of mercury in the leachate. These methods produced very similar results for the lamp according to the invention, all of which yielded TCLP compliance for the above-described F40T12 ECONOWATT lamps.

In addition, the F40T12 lamps according to the invention were also subjected to the State of California's Waste Extraction Test, (also known as the WET test.) (Reference—California Code of Regulations, Title 22, Vol. 29 herein incorporated by reference). Lamp preparation was done using the SAIC approach. The regulatory threshold or Soluble Threshold Limit Concentration for mercury is 0.2 ppm. Testing at Federal and California EPA—certified laboratories showed that the average STLC value for an end-of-life lamp was 0.01 ppm, well below the regulatory threshold. Thus the lamps also pass the WET test which is usually thought to be a more stringent test for mercury.

While preferred embodiments of the invention have been shown and described, various other embodiments and modifications thereof will become apparent to those of ordinary skill in the art, and will fall within the scope of the invention as defined by the appended claims. For example, the given mercury ranges on a volume basis are applicable to other lengths and tube diameters of lamps having a mercury protective layer and a halophosphate phosphor layer. Accordingly, the specification is to be considered to be illustrative only and not limiting.

What is claimed:

1. A low pressure mercury vapor fluorescent lamps comprising: a soda-lime glass lamp envelope sealed in a gas-tight manner and having an inner surface, an electrically conductive coating on said lamp envelope having a weight of between about 50 and about 100 mg/cm$^2$, a filling comprising mercury and rare gas within said lamp envelope, means for maintaining a column discharge within said lamp envelope, and a mercury-protective layer comprising an oxide formed from the group consisting of magnesium, aluminum, titanium, zirconium, and the rare earths on the inner surface of said lamp envelope, said mercury protective layer having a coating weight of between about 0.08 and about 0.30 mg/cm$^2$; and a halophosphate layer having a coating weight of about 4–5 mg/cm$^2$, said electrically conductive coating, mercury protective coating and halophosphate layer being disposed in the order, away from said lamp envelope, of electrically conductive coating, mercury protective coating and halophosphate layer;

said filling initially including a dose of elemental mercury selected such that (A) after about 20,000 hours of lamp operation in a rapid start mode a sufficient quantity of elemental mercury is available to support a column discharge, and (B) if said lamp is (1) pulverized into granules having a surface area per gram of pulverized material equal to or greater than 3.1 cm$^2$ or having a particle size smaller than 1 cm for the narrowest dimension of said particle and (2) the pulverized material is then subjected to a sodium acetate buffer solution having a PH of approximately 4.9 and a weight 20 times that of the pulverized granules, the maximum concentration of mercury in said leachate is less than 0.2 ppm; and said lamp being free of agents effective only upon crushing of said lamp for converting soluble mercury into insoluble mercury.

2. A lamp according to claim 1, wherein the ratio of said initial dose of elemental mercury to the volume enclosed by the discharge vessel is less than about $4.4\times10^{-3}$ mg/cm$^3$.

3. A lamp according to claim 2, wherein said mercury-protective layer consists essentially of aluminum oxide.

4. A lamp according to claim 3, wherein said mercury-protective layer is light transmissive and reflective of ultraviolet radiation and comprises an agglomerated particulate material of predominantly gamma alumina having a primary crystallite size of about 0.01 $\mu$m.

5. A lamp according to claim 1, wherein said mercury-protective layer consists essentially of aluminum oxide.

6. A lamp according to claim 1, wherein said means for maintaining a column discharge includes a discharge electrode, said lamp further including a metallic strip at least partly surrounding said electrode.

7. A lamp according to claim 1, characterized in that said luminescent layer further comprises a tri-component phosphor layer at a weight up to about 40% of the total weight of the tri-component phosphor plus the halophosphate phosphor.

8. A lamp according to claim 1, further comprising a capsule within said lamp envelope for introducing said mercury into said lamp vessel.

9. A low pressure mercury vapor fluorescent lamp, comprising:

a. a tubular, light transmissive lamp envelope having opposing sealed ends, an inner tubular surface and enclosing a discharge space between said sealed ends with a volume;

b. a filling of elemental mercury and a rare gas, said elemental mercury being dosed at an initial level relative to the volume of the discharge space of between about $2.9\times10^{-3}$ mg/cm$^3$ and $4.4\times10^{-3}$mg/cm$^3$;

c. a pair of tungsten discharge electrodes each arranged at a respective sealed end of said lamp envelope;

d. means for connecting said discharge electrodes to a source of electric potential outside of said lamp envelope, whereby during lamp operation a gas discharge is maintained between said discharge electrodes, which gas discharge emits ultraviolet radiation;

e. a first, light transmissive and ultraviolet radiation reflecting layer disposed adjacent said inner surface of said lamp envelope, said first layer comprising an agglomerated particulate material of predominantly gamma alumina having a primary crystallite size of about 0.01 $\mu$m, f. a second, luminescent layer on said first layer comprising a halophosphate phosphor and a third, tri-component phosphor layer on the halophosphate layer, the tri-component phosphor layer having a weight up to about 40% of the total weight of the tri-component phosphor plus the halophosphate phosphor.

10. A lamp according to claim 9, wherein said first layer of material has a weight per surface area of said inner surface of between about 0.08 mg/cm$^2$ and about 0.30 mg/cm$^2$.

11. A lamp according to claim 10, further comprising a metallic cathode guard surrounding each discharge electrode.

12. A lamp according to claim 11, wherein said sealed ends are free of said first layer.

13. A lamp according to claim 12, further including a glass capsule secured to said cathode guard for introducing said mercury into said lamp vessel.

14. A lamp according to claim 13, wherein said inner surface carrying said first and second layers has an area of about 1360 cm$^2$.

15. A lamp according to claim 9, wherein said inner surface carrying said first and second layers has an area of about 1360 cm$^2$.

16. A low pressure mercury vapor fluorescent lamp, comprising:

a. a tubular, light transmissive lamp envelope consisting essentially of lime glass, said lamp envelope having an inner surface extending between opposing ends thereof, a length between said opposing ends of about 120 cm and an inside diameter of about 3.8 cm;

b. a respective electrode mount structure at each end of said lamp envelope, each mount structure comprising a glass stem sealing said envelope in a gas-tight manner, a tungsten filament electrode including a coating of an electron emissive material, and a pair of conductive feed-throughs connected to said filament and extending through said glass stem to the exterior c. an electrically conductive coating disposed directly on said inner surface of said lamp envelope, said coating having a weight of about 50 to about 100 mg/cm$^3$;

d. a first, light transmissive and ultraviolet radiation reflecting layer disposed on said electrically conductive coating, said first layer consisting essentially of an agglomerated particulate material of predominantly gamma alumina having a primary crystallite size of about 0.01 $\mu$m, said first layer having a coating weight of between about 0.15 mg/cm$^2$ and about 0.30 mg/cm$^2$ of said inner surface; and e. a second layer of luminescent material disposed on said first layer, said luminescent material consisting essentially of a halophosphate phosphor having a coating weight in the range of about 4–5 mg/cm$^2$; and f. a filling within said lamp envelope comprising a rare gas and mercury, said mercury having an initial weight of between about 4 mg and about 6 mg;

said lamp having a standard lamp life of about 20,000 hours when operated in a rapid start mode.

17. A lamp according to claim 16, wherein said electrically conductive coating comprises $SnO_2$.

18. A lamp according to claim 16, further comprising a metallic cathode guard surrounding each discharge electrode.

19. A lamp according to claim 16, wherein said sealed ends are free of said first layer.

20. A lamp according to claim 16, further including a glass capsule secured to said cathode guard for introducing said mercury into said lamp envelope.

21. A low pressure mercury vapor fluorescent lamp, comprising:

a. a tubular, light transmissive lamp envelope consisting essentially of lime glass, said lamp envelope having an inner surface extending between opposing ends thereof, a length between said opposing ends of about 120 cm and an inside diameter of about 3.8 cm;

b. a respective electrode mount structure at each end of said lamp envelope, each mount structure comprising a glass stem sealing said envelope in a gas-tight manner, a tungsten filament electrode including a coating of an electron emissive material, and a pair of conductive feed-throughs connected to said filament and extending through said glass stem to the exterior c. an electrically conductive coating disposed directly on said inner surface of said lamp envelope, said coating having a weight of about 50 to about 100 mg/cm$^3$;

d. a first, light transmissive and ultraviolet radiation reflecting layer disposed on said electrically conductive coating, said first layer consisting essentially of an agglomerated particulate material of predominantly gamma alumina having a primary crystallite size of about 0.01 $\mu$m, said first layer having a coating weight of between about 0.08 mg/cm$^2$ and about 0.30 mg/cm$^2$ of said inner surface; and e. a second layer of luminescent material disposed on said first layer, said luminescent material consisting essentially of a halophosphate phosphor, and a third, tri-component phosphor layer on the halophosphate layer, the tri-component phosphor layer having a weight up to about 40% of the total weight of the tri-component phosphor plus the halophosphate phosphor; and f. a filling within said lamp envelope comprising a rare gas and mercury, said mercury having an initial weight of between about 4 mg and about 6 mg.

* * * * *